United States Patent [19]

Pyles et al.

[11] 3,990,522

[45] Nov. 9, 1976

[54] ROTARY PERCUSSION DRILL

[75] Inventors: Harley G. Pyles; Charles D. Albright, both of Fairmont, W. Va.

[73] Assignee: Mining Equipment Division, Fairmont, W. Va.

[22] Filed: June 24, 1975

[21] Appl. No.: 589,907

[52] U.S. Cl. ..... 173/78; 173/105; 173/115; 175/56

[51] Int. Cl.[2] ..... E21C 1/12; B25D 15/00

[58] Field of Search ..... 173/60, 57, 105, 49, 173/104, 108, 78, 160, 115; 175/56

[56] References Cited

UNITED STATES PATENTS

| | | | |
|---|---|---|---|
| 2,942,849 | 6/1960 | Bodine | 173/49 |
| 3,190,369 | 6/1965 | Pyles | 173/160 |
| 3,262,507 | 7/1966 | Hansen | 175/56 |
| 3,547,206 | 12/1970 | Phillips | 173/57 |
| 3,735,821 | 5/1973 | Hahner et al. | 173/104 |
| 3,811,515 | 5/1974 | Bazhal et al. | 173/108 |

*Primary Examiner*—James A. Leppink
*Attorney, Agent, or Firm*—Stanley J. Price, Jr.; John M. Adams

[57] ABSTRACT

A drill housing is pivotally connected to the forward end portion of a boom member that swings upwardly from a frame of a mobile drilling machine. A hydraulic motor is secured to the gear housing and provides rotary power from a drive shaft through a pair of meshing gears to a drill chuck that is arranged to receive a drill bit or a roof bolt. A percussion weight is concentrically positioned within the drill housing and is axially aligned with the drill bit for imparting percussive forces to the drill bit. The percussion control is maintained through a servovalve that is supported on the drill housing and is controlled remotely by an electronic control module. The servovalve controls the flow of pressurized fluid from a source through ports in the drill housing connected to the servovalve by conduits to actuate a piston member for oscillation within the drill housing. Oscillation of the piston imparts a percussive force upon the percussion weight which is transmitted to the drill bit. By reversing the fluid flow between the respective ports of the servovalve the piston is oscillated within the drill housing to provide for variable percussive rates at a variable stroke to permit high speed drilling in solid rock.

10 Claims, 4 Drawing Figures

ROTARY PERCUSSION DRILL

BACKGROUND OF THE INVENTION

1. Field of the Invention

This invention relates to a rotary percussion drill and more particularly to a hydraulically operated drill that combines the effects of rotation and percussion where the percussion is controlled by a servovalve at variable frequency and stroke.

2. Description of the Prior Art

Rotary percussion drills which combine rotational and percussive forces to produce high torque and high speed for rock drilling in underground mines are well known in the art. U.S. Pat. 3,547,206 discloses a hydraulically operated reciprocating piston for imparting percussion forces to a drill rod nonrotatably connected to a drill rod support member. A multivalve control device opens and closes the valve ports which supply pressurized fluid to the cylinder housing the piston. The timing device controls the opening and closing of the valve, thereby controlling the rate of percussion of the piston. A timing device for supplying fluid under pressure to the cylinder also functions as a positive displacement to displace excess fluid supplied to the cylinder.

U.S. Pat. No. 3,467,207 teaches an extensible drilling machine having both rotary and percussion drive means provided in a drill head. A hydraulic motor provides both the rotary action and the percussion action. The rotary percussion drill has a motor for driving four matched eccentric weights. The weights apply thrust forces to the drill head in a direction parallel to the longitudinal axis of the drilling implement. Thus, linear forces are imparted to the drilling implement, and the eccentric weights rotate in pairs in opposite directions. The weights are in forward and in rear positions at the same time enabling the forces to combine and either add or subtract from the force already being applied as the thrust.

With conventionally known rotary percussion drills of the valve type and primarily those which are actuated by pneumatic pressure, the rate at which the drill bit may be advanced is limited by the opening and closing of the valves and further by the inherent losses that take place in a pneumatic system. On the other hand, rotary percussion drills that utilize eccentric weights to impart percussive forces experience substantial vibration that shortens bit life and reduces drilling rates. Furthermore, the vibration problem is compounded by excessive noise levels encountered when the drill is operated in the percussion mode.

There is need to provide hydraulically operated rotary percussion drill that in the percussion mode reduces the vibration and noise level and provides variable stroke and frequency for drilling in hard rock at drilling speeds up to 3 and 4 feet per minute.

SUMMARY OF THE INVENTION

In accordance with the present invention, there is provided a rotary percussion drill that includes a housing having an opening extending therethrough. A rotatable drill retaining member is positioned in the housing and has a central bore extending therethrough. A hydraulic drive means rotates the drill retaining member at a preselected speed. A drive shaft is drivingly connected to the drive means and extends through the housing opening. A first gear member is nonrotatably secured to the drive shaft, and a second gear member is connected in meshing relation to the first gear member. The second gear member is nonrotatably connected to the drill retaining member and thus transmits rotation from the drive means to the drill retaining member. An oscillating mechanism imparts a percussive force to the drill retaining member. The oscillating mechanism is concentrically supported with the drill retaining member in the housing. An actuator is concentrically positioned for linear movement within the housing and is operable to vertically reciprocate the oscillating mechanism. A valve member controls the reciprocating movement of the actuator to transmit a variable percussive force from the actuator through the oscillating mechanism to the drill retaining member. Conduits are provided for connecting the valve with the actuator to provide for flow of pressurized fluid from the valve to the actuator and further electrical means are provided for controlling the valve to generate a preselected percussion rate.

Preferably, the valve is a servovalve which through an electronic control module maintains percussion control. The servovalve receives hydraulic fluid through one port from a pressurized source and returns the fluid to the tank through another port. The fluid is then conducted to the actuator of the rotary percussion drill. The actuator includes a vertically movable piston that is arranged to impart a percussive force to the drill bit retained within a drill chuck. The servovalve is operated to alternately direct fluid flow to and from the actuator and thereby reciprocate the piston at a preselected frequency. In this manner, a preselected percussion force at a preselected stroke is imparted upon the drill bit.

When a selected port of the servovalve is pressurized the other port is arranged for return flow to the fluid reservoir. By directing pressurized fluid through selected ports the piston is actuated and accelerates the oscillator which comprises a percussion weight for impacting the drill bit. When the fluid flow is reversed by the operation of the servovalve, the initially pressurized port is connected to the reservoir, and the port initially connected to tank is pressurized so that the piston will move downwardly. In this manner, the percussion weight is removed from contact with the drill bit. The piston and percussion weights are returned to their initial positions for impacting further the percussive forces upon the drill. The frequency at which the impacting cycle commences and the length of the stroke is controlled through the control module of the servovalve.

Accordingly, the principal object of the present invention is to provide a rotary percussion drill for drilling bolt holes and installing roof bolts in a mine roof through the combined effects of rotation and hydraulic percussion where the percussion rate is selected by the operator through a servovalve that controls the flow of pressurized fluid to the percussion components of the drill.

Another object of the present invention is to provide a rotary percussion drill that is hydraulically operated to provide percussive forces imparted to a drill bit to provide an impacting cycle of variable stroke and frequency so that the impacting cycle may be adjusted to the natural frequency of the material being drilled to produce an amplification of the presssure exerted at the tip of the drill bit and thereby permit drill rates in the range of 3 to 4 feet per minute in hard rock.

These and other objects of this invention will be more completely disclosed and described in the following specification, the accompanying drawings and the appended claims.

DESCRIPTION OF THE PREFERRED EMBODIMENTS

Figure 1:
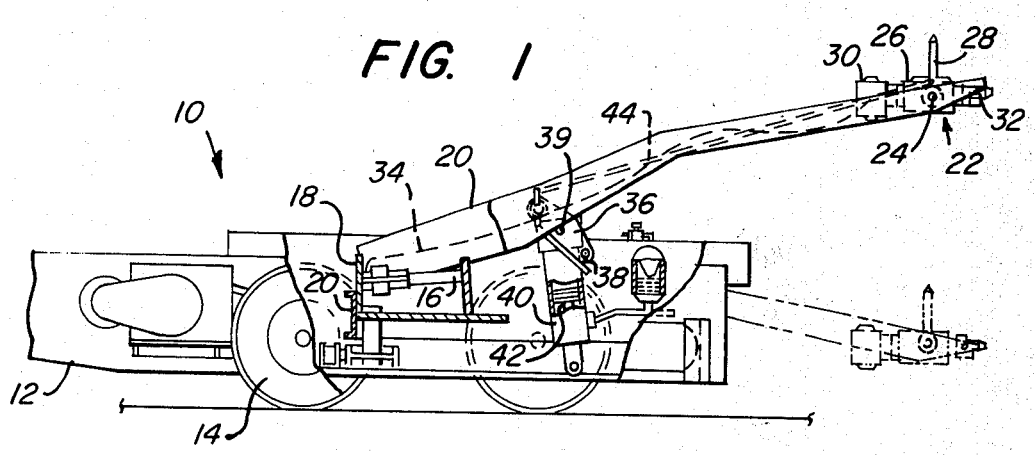
FIG. 1 is a view in side elevation of a mobile drilling machine, illustrating the rotary percussion drill of the present invention pivotally mounted to the forward end portion of the drilling machine boom.

Referring to the drawings and more particularly to FIG. 1, there is illustrated a mobile drilling machine generally designated by the numeral 10 that includes a frame 12 supported by wheels 14 for movement in a mine. Boom supporting rails 16 are carried by the frame 12 and extend longitudinally thereof. Sleeves 18 are slidably mounted on the rails 16, and a boom 20 is pivotally connected at its rearward end portion to the sleeves 18 so that it may move forwardly and backwardly and tilt vertically relative to the frame 12.

A rotary percussion drill generally designated by the numeral 22 is rotatably supported by trunnions 24 to the forward end portion of the boom 20. The drilling thrust is delivered to the drill 22 from the boom 20 through the trunnions 24. The drill 22 includes a housing 26 which rotatably supports a drill bit 28 that is rotated at a preselected speed by a hydraulic motor 30 that is carried by the drill 22. Simultaneously with or independent of the rotary motion imparted to the drill 28 by the hydraulic motor 30, a servovalve 32 provides for vertical reciprocating movement of the drill bit 28. In this manner, percussive forces are imparted to the solid material by the rotating bit 28. Pressurized fluid provided from a source on the machine frame 12 is supplied by conduits 34 along the boom 20 to the hydraulic motor 30 and the servovalve 32.

The boom 20 is connected intermediate the end portions thereof to a lever 36 that is pivotally connected at one end by pin 38 to the machine frame 12. A boom jack 40, such as a conventional hydraulic cylinder assembly having an extensible piston rod 42, is pivotally mounted on the machine frame 12. The upper end portion of the boom jack 40 is pivotally connected to the lever 36 by pin 39 and is operable upon actuation to swing the boom lever 36 about the pivot pin 38 to thereby raise and lower the boom 20. The connection between the boom lever 36 and boom 20 results in arcuate movement of the forward end portion of the boom 20; however, the rearward end portion of the boom 20 slides along the rails 16 to produce a resultant vertical linear movement of the boom forward end portion.

The drill assembly 26 is pivotally connected by the trunnions 24 to the boom forward end portion. A levelling linkage 44 is interposed between the drill assembly 22 and the boom lever 36. The levelling linkage 44 is pivotal about the boom lever 36 to maintain vertical positioning of the drill 22 and hence the drill bit 28 as the drill boom 20 is raised and lowered. A description of the drilling machine 10 is set forth in greater detail in U.S. Pat. 3,190,369.

Figure 3:
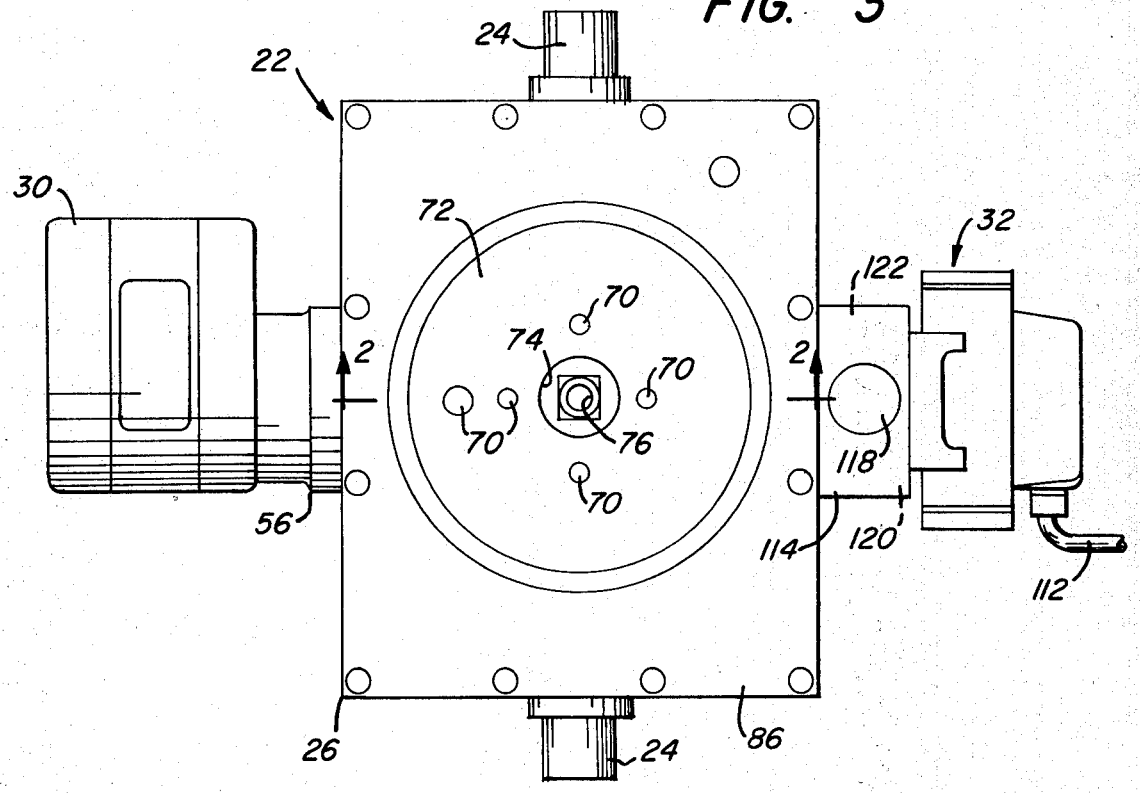
FIG. 3 is an enlarged top plan view of the rotary percussion drill that is supported by the boom member of the mobile drilling machine illustrated in FIG. 1.
Figure 2:
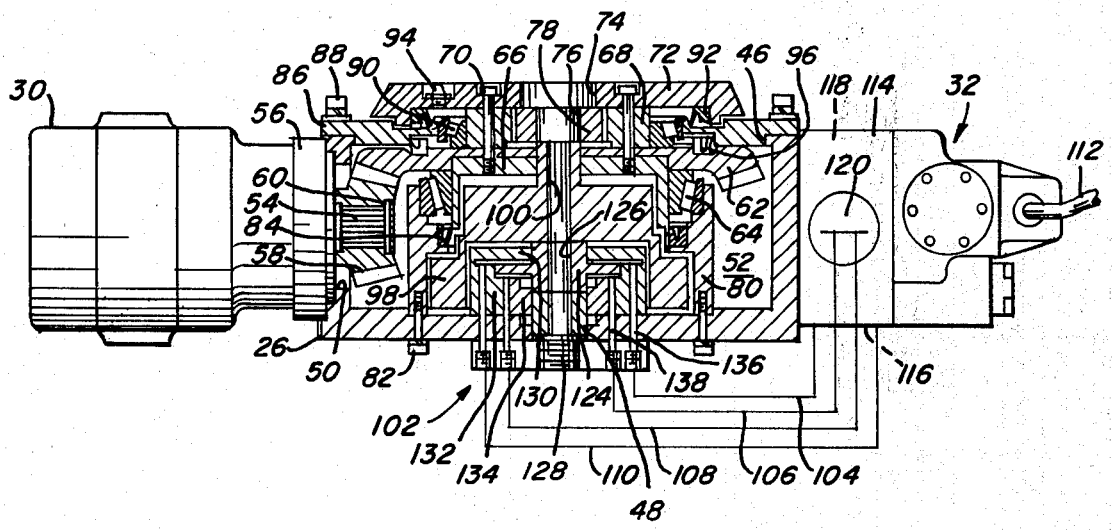
FIG. 2 is a view in side elevation partially in section taken along the line 2—2 of FIG. 3, illustrating a hydraulic motor for imparting rotational movement to the drill chuck and a servovalve for imparting percussive forces at a preselected rate to the drill retaining member.

Referring to FIGS. 2 and 3 of the drawings, drill housing 26 of the rotary percussion drill 22 includes an open upper end portion 46, a bore 48 in the lower end portion and a cylindrical opening 50 in one side of the housing 26 to define a housing chamber 52. The motor 30 is a conventional variable speed hydraulic motor and is secured by a collar 56 to the drill housing 26. A drive shaft 54 of the motor 30 extends through the cylindrical opening 50. The drive shaft 54 is fitted with a bevel gear 58 that is secured to the end of the shaft by a retaining ring 60. The bevel gear 58 meshes with a ring gear 62 that is rotatably supported and concentrically positioned within the housing chamber 52 by tapered roller bearing 64. The ring gear 62 is nonrotatably secured to an annular shaped spindle 66. The ring gear 62 and the spindle 66 are, in turn, nonrotatably secured to a drill retaining member, such as a drill chuck 68, by bolts 70 that extend through a dust cover 72 positioned above the upper open end portion 46 of the drill housing 26. The dust cover 72 includes an axial bore 74 that is coaxially aligned with a bore 76 of insert 78 that is splined to the drill chuck 68. The drill bit (not shown) is nonrotatably secured within the splined insert 78 so that the torque supplied by motor drive shaft 54 is transmitted to the ring gear 62 and the chuck 68 to rotate the insert 78 and the drill bit.

The tapered roller bearing 64 is supported by a bearing retainer 80 that is secured to the lower portion of the drill housing 26 by bolts 82. Thus, the bearing retainer 80 and the ring gear 62 are concentrically positioned within the drill housing 26 to carry the thrust forces generated by the rotating gears 58 and 62. The bearing retainer 80 additionally supports oil seal 84 that surrounds the spindle 66 and excludes the gear lubricant for the bevel gear 58 and the ring gear 62 from the percussion assembly hereinafter described.

A cover plate 86 closes the open upper end portion 46 of the drill housing 26 and is secured thereto by bolts 88. The cover plate 86 supports roller bearing 90 that is arranged to carry the thrust load created by the separating forces of the bevel gear 58 and ring gear 62. In this manner, the upper roller bearing 90 carries any radial loads resulting from improper alignment of the drill bit within the insert 78 and drill chuck 68. A grease seal 92 is retained between the dust cover 72 and the cover plate 86 to exclude foreign material from the roller bearing 90. The roller bearing 90 is lubricated by grease through the grease fitting 94. Furthermore, grease seal 96 positioned between the cover plate 86 and the ring 62 prevents the gear oil from washing the lubricant from the bearing 90.

Percussive forces are imparted to the drill bit retained within the drill chuck 68 and insert 78 by an oscillating member, such as the percussion weight 98. The percussion weight 98 has an annular configuration with an axial bore 100 extending therethrough. The bearing retainer 80 is positioned in surrounding relation with the percussive percussion weight 98 that is arranged for vertical reciprocal movement within the housing chamber 52 by operation of an actuator generally designated by the numeral 102.

The actuator 102 is connected by conduits 104, 106, 108 and 110 to the outlets of the servovalve 32. The servovalve 32 maintains the percussion control, and in turn, is controlled by an operator through an electronic control module (not shown) connected to the servovalve 32 by electrical conductor 112. The servovalve 32 is operable to selectively vary the percussion frequency from 0 to 2500 cycles per minute and to selectively vary the stroke of the drill bit from 0 to ⅛ inch. A specific servovalve suitable for use in the present invention is manufactured by Moog, Inc., Controls Division, East Aurora, New York, and sold under the product name Moog Series 72 Servovalve. The above mentioned servovalve is suitable for use in underground mining in combination with a conventional control module and is designed so that the electrical control power is sufficiently low to be within the safety standards for underground mining.

The servovalve 32 includes a manifold portion 114 having inlet ports 116 and 118, as illustrated in FIGS. 2 and 3. Hydraulic fluid enters the servovalve manifold 114 through port 116 and is exhausted from the manifold 114 to a suitable tank reservoir through port 118. Further, the servovalve 32 is operable to transmit fluid from outlet port 120 in manifold 114 to the actuator 102 and to receive the fluid from the actuator 102 through outlet port 122. With this arrangement, the ports 116 and 118 and ports 120 and 122 in manifold 114 are alternately operable as inlet and outlet ports for controlling the flow of fluid by servovalve 32 to and from the actuator 102. Specifically, when port 120 is internally ported to receive pressurized fluid from port 116, then port 122 is internally ported to return fluid to port 118. Then conversely, when port 122 by operation of the servovalve 32 is internally ported to receive pressurized fluid from port 116, then port 120 is internally ported to return the fluid from the actuator 102 back to port 118 and therefrom to the fluid reservoir.

The actuator 102 for imparting oscillating percussive forces to the drill bit includes a piston 124 coaxially positioned with the percussion weight 98 in the housing chamber 52. The piston 124 has a radially extending flanged portion 125 and an axial bore 126 that is aligned with the bore 100 of percussion weight 98 and the bore 76 of insert 78. With this arrangement, dust from the drilling operation is collected through an outlet 128 communicating with the piston bore 126. The outlet 128 and the actuator 102 are connected to a conventional vacuum dust collecting system. Vertical movement of piston 126 within the housing chamber 52 is maintained concentric within the drill housing 26 by the annular members 130, 132 and 134.

Annular members 130 and 132 are separated by passageways 136 that communicate with the upper flanged surface of piston 124 and in a similar manner passageways 138 separate annular members 132 and 134 and communicate with the lower flanged surface of piston 124. Passageways 136 are connected by conduits 104 and 110 to port 122 in the servovalve manifold 114. Similarly, passageways 138 are connected by conduits 106 and 108 to port 120 in the servovalve manifold 114. With this arrangement, transmitting pressurized fluid from port 120 to the passageways 138 and discharging the fluid from the actuator 102 to port 122 activates the piston 124 to accelerate the percussion weight 98 upwardly to impart an impact blow upon the drill bit retained within the drill chuck insert 78.

When the pressurized fluid flow is reversed by the servovalve 32 the passageways 136 receive a positive flow of fluid from port 122; whereas, passageways 138 are directed to the fluid reservoir for discharging the pressurized fluid from the actuator 102. Consequently, the piston 124 moves downwardly within the chamber housing 52 to relieve the upward force exerted upon the percussion weight 98. The weight 98 will then return to its initial position in the housing 26 before it imparts another percussive force upon the drill bit. It is through the operation of the servovalve 32 by electronic control that the frequency and stroke of the percussive forces are selected. By selecting a percussion stroke having a frequency that is equal to the natural or resonant frequency of the rock strata being drilled, the energy stored in the rock strata by the percussion forces will result in amplification of the pressure exerted at the tip of the drill bit. The amplification of the pressure will reach a magnitude that will become so great that the solid material will collapse and dislodge and permit drill rates in the range of 3 to 4 feet per minute.

Figure 4:
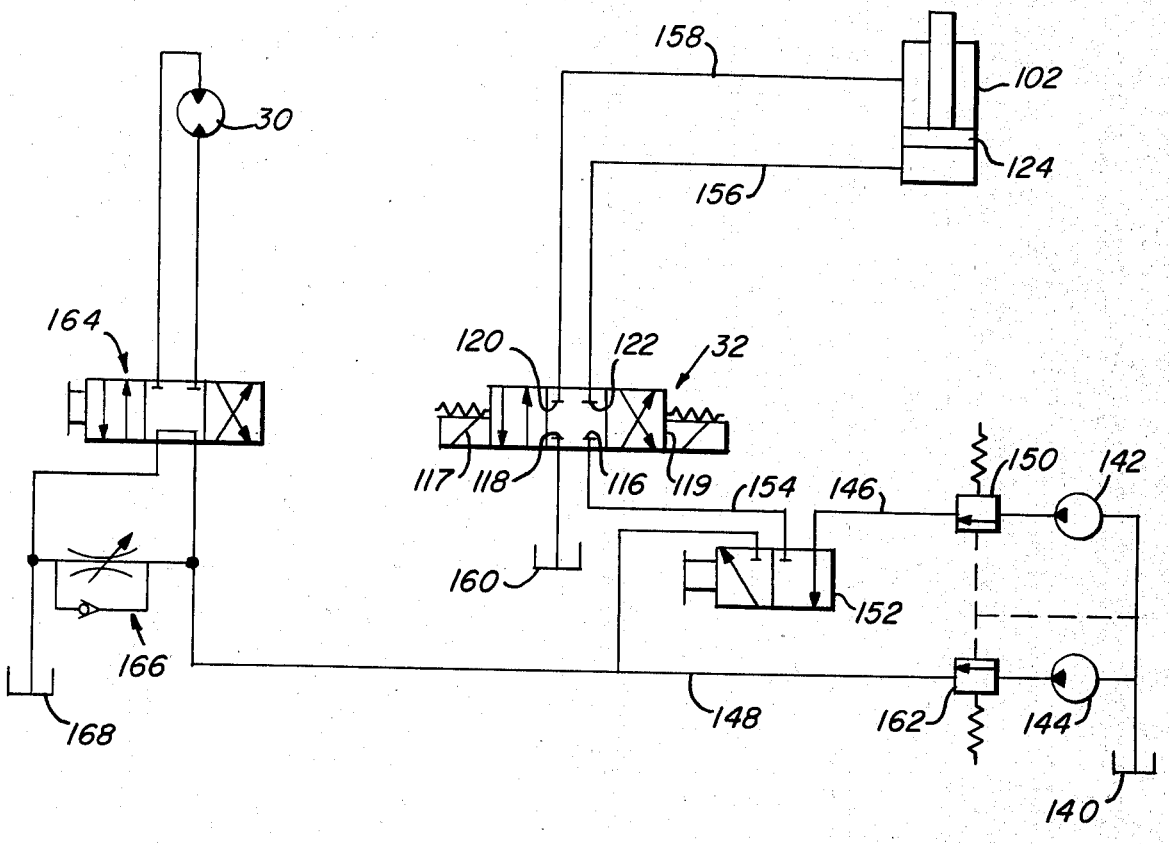
FIG. 4 is a hydraulic schematic diagram illustrating the hydraulic connections to the drive motor and the servovalve of the rotary percussion drill.

The alternating operation of the servovalve 32 to provide for variable stroke and frequency of oscillation of the actuator piston 124 is schematically illustrated in FIG. 4. With this arrangement, pressurized fluid is withdrawn from a reservoir 140 by pumps 142 and 144 through conduits 146 and 148, respectively, to the servovalve 32 and the motor 30. Spring biased control valve 150 controls the flow of pressurized fluid from the pump 142 to a holding reservoir 152 for flow to the servovalve 32.

A percussive force is imparted to the drill bit by actuating the servovalve 32 through the control module to pressurize port 116 and communicate port 122 with port 116 by the spring biased valve 117. In this manner, flow is directed from conduit 154 through ports 116 and 122 to conduit 156. Pressurized fluid is then charged into the chamber of the actuator 102 below the piston 124 to drive the piston upwardly and impart a percussive force at a preselected frequency and stroke upon the drill bit. The upwardly moving piston 124 discharges fluid from the upper chamber of actuator 102 through conduit 158 and the communicating ports 120 and 118 of the valve 117 into the tank 160.

With the piston 124 in its uppermost position within the actuator 102, the servovalve 32 is actuated to reverse the fluid flow. Pressurized fluid is withdrawn from the reservoir 152 through conduit 154 and is directed by spring biased valve 119 from port 116 to port 120 of servovalve 32. Flow through conduit 158 is directed to the chamber of the actuator 102 above the piston 124. The piston 124 is driven downwardly from contact with the percussion weight 98 illustrated in FIG. 3. The fluid is discharged from the lower portion of the actuator 102 through conduit 156 and is directed from port 122 to port 118 by valve 119 to the tank 160.

By controlling the rate at which the servovalve 32 directs fluid to the actuator 102 and in the proper sequence, the piston 124 is oscillated within the actuator 102 to impart percussive forces upon the drill bit of the drill 22. Simultaneously with the percussive action, the hydraulic motor 30 receives pressurized fluid from reservoir 140 by the pump 144 charging fluid through a spring biased control valve 162 to conduit 148. The motor 30 is driven in a preselected direction by operation of spring biased valve 164 and by pass valve 166 to control the fluid flow between the motor 30 and tank 168.

According to the provisions of the patent statutes, we have explained the principle, preferred construction and mode of operation of our invention and have illustrated and described what we now consider to represent its best embodiments. However, it should be understood that, within the scope of the appended claims, the invention may be practiced otherwise than as specifically illustrated and described.

We claim:

1. A rotary percussion drill comprising, a drill housing having an opening extending therethrough, a rotatable drill retaining member positioned in said drill housing, said drill retaining member having a central bore therethrough, drive means for rotating said drill retaining member at a preselected speed, a drive shaft drivingly connected to said drive means and extending through said drill housing opening, a first gear member nonrotatably secured to said drive shaft, a second gear member connected in meshing relation to said first gear member and nonrotatably connected to said drive means to said drill retaining member, an oscillating means for imparting a percussive force to said drill retaining member, said oscillating means concentrically supported with said drill retaining means in said drill housing, actuator means for vertically reciprocating said oscillating means, said actuator means concentrically positioned in said drill housing for linear movement, valve means for controlling the flow of pressurized fluid to and from said actuator means so that a percussive force of variable stroke and frequency is transmitted through said oscillating means to said drill retaining means, conduit means connecting said valve means with said actuator means for directing the flow of pressurized fluid from said valve means to said actuator means, and control means for actuating said valve means to generate a preselected percussive rate.

2. A rotary percussion drill as set forth in claim 1 in which said oscillating means includes, a percussion member having an annular configuration with an axial bore extending therethrough, said percussion member being coaxially aligned with said drill retaining member and said actuator means in said drill housing, said percussion member positioned in said drill housing for linear reciprocating motion between said drill retaining member and said actuator means by the movement of said actuator means.

3. A rotary percussion drill as set forth in claim 1 in which said actuator means includes, a piston concentrically supported for linear reciprocating movement within said drill housing and having an end portion positioned in abutting relation with said oscillating means, said piston coaxially aligned in said drill housing with said oscillating means and having a flanged portion extending radially of said piston with upper and lower surfaces communicating with said valve means, and said valve means operable upon actuation to alternately direct flow of pressurized fluid to said piston upper and lower flanged portion surfaces to reciprocate said piston within said drill housing at a preselected frequency.

4. A rotary percussion drill as set forth in claim 1 which includes, means for collecting dust generated by the rotary percussion drilling action.

5. A rotary percussion drill as set forth in claim 4 which includes, said actuator means having an axial bore extending therethrough, said oscillating means having an axial bore coaxially aligned with said drill retaining member and said actuator means bore such that dust generated by the rotary percussion drilling action is directed from said drill retaining member through said aligned bores of said oscillating means and said actuator means for removal from said drill housing.

6. A rotary percussion drill as set forth in claim 1 in which said valve means includes, a servovalve having a plurality of inlet ports for receiving pressurized fluid from a source and a plurality of outlet ports for directing the fluid to and from said actuator means, said conduit means connecting said outlet ports to said actuator means, said control means operable to sequentially alternate the fluid flow through said outlet ports to said actuator means such that certain of said outlet ports are pressurized to direct fluid to said actuator means and the remaining outlet ports are vented to discharge fluid from said actuator means to thereby reciprocate said actuator means and generate a percussive force of a preselected frequency.

7. A rotary percussion drill as set forth in claim 6 which includes, said valve means operable to alternate the flow of pressurized fluid to and from said actuator means between said outlet ports to vary the frequency of the percussive force applied to the drill retaining member in the range between about 0 to 2500 cycles/minute for a percussive stroke having a length in the range between about 0 to ⅛ inch.

8. A rotary percussion drill as set forth in claim 1 which includes, said valve means operable to control the pressurized fluid flow through said conduit means to and from said actuator means such that said actuator means reciprocates within said drill housing and urges said oscillating means to transmit a percussive force to said drill retaining means at a preselected frequency corresponding to a resonant frequency of the solid material being drilled.

9. A drill for rapidly drilling hard material comprising, a drill housing, a rotatable drill rod retaining member carried in said housing, a drill rod extending from said drill rod retaining member into contact with the hard material, a drive means connected to said housing and to said drill rod retaining member for rotating said member at a selected speed, an oscillating member located in said housing to impart a rapid frequency of percussive blows to said drill retaining member, and control means connected to said oscillating member for automatically controlling the frequency of said percussive blows to correspond to a resonant frequency of the hard material.

10. A drill for percussive drilling hard material at a percussive rate corresponding to a resonant frequency of the hard material comprising, a drill housing having an opening extending therethrough, a rotatable drill rod retaining member positioned in said drill housing opening, a drive means drivingly connected to said drill rod retaining member for rotating said drill rod retaining member at a selected speed, an oscillating means for imparting percussive forces to said drill rod retaining member at a rapid rate, said percussive forces being transmitted to the bit of a drill rod held in said drill rod retaining means, actuator means for reciprocating said oscillating means, and control means for controlling the rate of reciprocation of said actuator means, said control means automatically adjusting the rate of reciprocation to correspond to a resonant frequency of the hard material being drilled.

* * * * *